United States Patent [19]

Reich

[11] Patent Number: 4,516,423

[45] Date of Patent: May 14, 1985

[54] VEHICLE FRAME CLAMPING AND SUPPORT APPARATUS

[75] Inventor: George Reich, Elgin, Ill.

[73] Assignee: Unibody Time Saver Corporation, Elgin, Ill.

[21] Appl. No.: 465,450

[22] Filed: Feb. 11, 1983

[51] Int. Cl.[3] ..... B21D 1/14

[52] U.S. Cl. ..... 72/422; 72/705; 269/239; 269/258

[58] Field of Search ..... 72/422, 705; 269/239, 269/258, 264

[56] References Cited

U.S. PATENT DOCUMENTS

| | | | |
|---|---|---|---|
| 998,248 | 7/1911 | Jahn | 269/258 |
| 1,844,616 | 2/1932 | Whiton | 269/258 |
| 3,091,278 | 5/1963 | Padgett | 72/705 |
| 3,630,066 | 12/1971 | Chisum | 72/705 |
| 4,344,314 | 8/1982 | Aldrich et al. | 72/705 |
| 4,400,969 | 8/1983 | Specktor | 72/705 |
| 4,404,838 | 9/1983 | Hare | 72/705 |

FOREIGN PATENT DOCUMENTS

| | | | |
|---|---|---|---|
| 2745807 | 4/1979 | Fed. Rep. of Germany | 72/705 |

*Primary Examiner*—Lowell A. Larson

*Attorney, Agent, or Firm*—Leydig, Voit, Osann, Mayer & Holt, Ltd.

[57] ABSTRACT

An apparatus for reliably engaging and supporting a motor vehicle frame for use in vehicle frame and body straightening. The illustrated apparatus includes a plurality of frame engaging clamping heads which each comprise a pair of relatively movable jaw supports, biasing springs interposed between the supports for biasing the supports in a jaw opening position, clamping bolts extending through said supports for selectively moving the jaw supports into clamping position against the biasing force of the interposed springs, and clamping jaws carried by said supports with a floating mounting that permits limited pivotal jaw movement relative to the supports during clamping for enhancing reliable engagement of the jaws with a vehicle frame regardless of surface irregularities. Selectively adjustable mounting arrangements are illustrated for mounting a plurality of such clamping heads on a vertically adjustable frame press, and alternatively, on ground supports, in each case forming a unitized four point frame engagement and support structure.

23 Claims, 10 Drawing Figures

VEHICLE FRAME CLAMPING AND SUPPORT APPARATUS

DESCRIPTION OF THE INVENTION

The present invention relates generally to automotive vehicle frame and body straightening equipment, and more particularly, to such equipment with improved means for engaging, supporting, and retaining the vehicle during the straightening operation.

For many years automotive vehicles were constructed with a rectangular frame structure and a separate body bolted to the frame. If such vehicle was involved in a collision, the frame often became twisted, or otherwise deformed, and required straighening if the vehicle was to be properly repaired. For some time there has existed frame straightening equipment which included a frame press typically mounted between ramps upon which the vehicle is driven, means such as chains for securing the vehicle to the frame press at a plurality of points, and means for coupling one or more hydraulic pull rams or other force exerting means between selected points on the vehicle frame and points on the frame press or the immediate vicinity of the frame press. Such equipment generally included means for raising the frame press relative to the runways for relieving tension of the vehicle suspension system, but because of the difficulty in securing the vehicle to the frame press, it usually was not possible to reliably or safely elevate the vehicle completely off the runways without the use of separate jacks. With the vehicle appropriately secured to the frame press, by selective actuation of the pull rams forces then could be exerted on the vehicle to reshape the frame as required.

Prompted by weight and fuel efficiency considerations, in recent years there has been a significant change in the design of automative vehicle bodies. To date, nearly all foreign automobiles and most small size American made automobiles are constructed with what has become known as a "unit body", which comprises a body and a relatively lightweight frame welded thereto to form a unitized frame and body structure. Such unit bodies, however, have not lent themselves to easy or effective straightening by conventional frame straightening equipment. For example, it usually is not possible to attach chains or the like directly to the frame of such unit bodies, and as a result, it has been difficult and cumbersome to secure the body to the frame press. Although it has been a common practice to weld attachment plates to the vehicle frame and then chain the attachment plate to the press, such procedure is time consuming and thus expensive. Moreover, because of the lighter weight construction of the unit body, the various means for securing the vehicle body to the frame press frequently caused deformation or damage to the body at the point of attachment when the straightening forces were applied to the vehicle.

It is an object of the present invention to provide a motor vehicle frame straightening apparatus that is adapted for efficient and reliable use on vehicles with unit body constructions.

Another object is to provide a frame straightening apparatus as characterized above which is adapted to permit easy securement of the vehicle to a frame press.

A further object is to provide a frame straightening apparatus of the above kind that is adapted to reliably clamp and secure the unit body of a vehicle in place on the frame press, as well as permit the frame press to safely raise and hold the vehicle in elevated positions if desired.

Still another object is to provide a clamping device that may be utilized with conventional frame straightening equipment to permit more effective and efficient use of such equipment on vehicles with unit body constructions.

Other objects and advantages of the invention will become apparent upon reading the following detailed description and upon reference to the drawings, in which.

Figure 1:
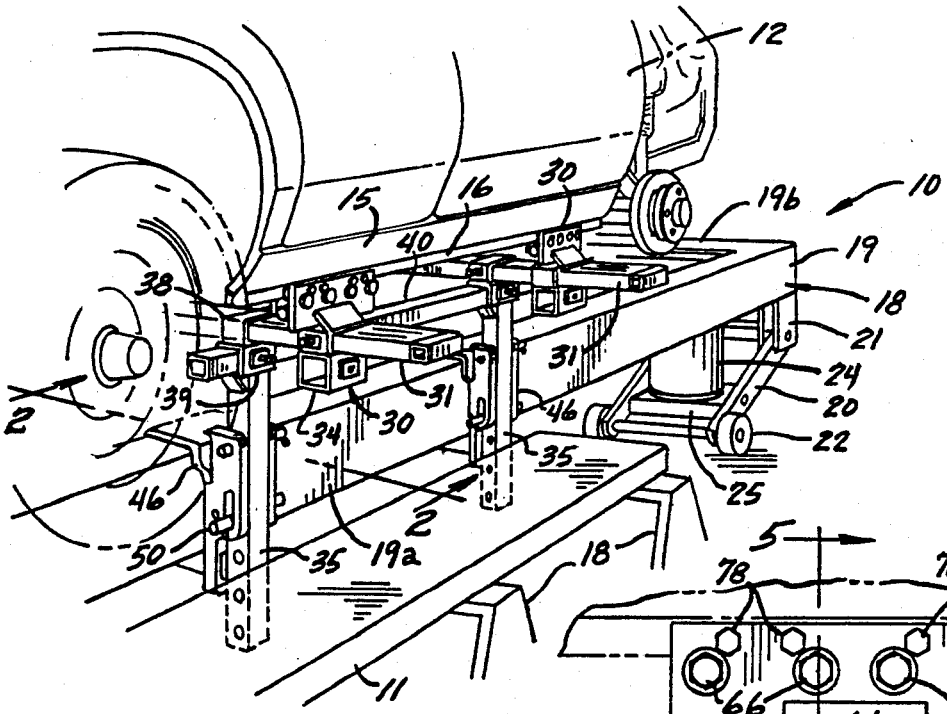
FIG. 1 is a perspective of a frame press having vehicle supporting and engaging means embodying the present invention, showing in phantom a vehicle held in position for frame straightening.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the invention is to cover all modifications, alternative constructions and equivalents falling within the spirit and scope of the invention.

Figure 3:
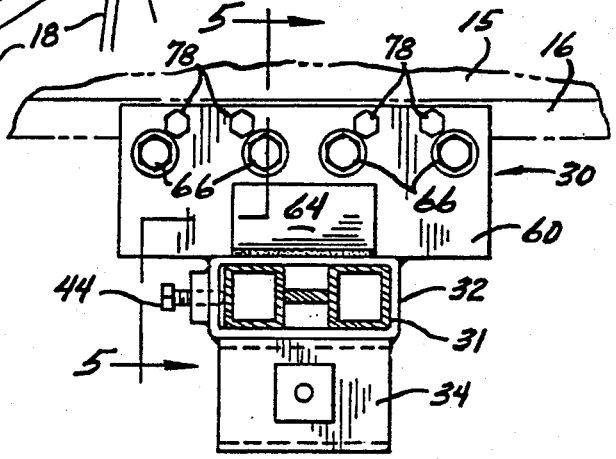
FIG. 3 is an enlargement vertical section taken in the plane of line 3—3 in FIG. 2.

Referring now more particularly to FIG. 1 of the drawings, there is shown an illustrative vehicle frame engaging and support apparatus 10 embodying the present invention disposed between a pair of transversely spaced parallel vehicle support ramps 11 (one of which is depicted in the drawing). The vehicle support ramps 11 are of the conventional type, each having a plurality of support horses 18 and a common end (not shown) that is inclined to floor level in the usual manner to permit a vehicle to be driven up onto the ramps 11. The apparatus 10 is shown supporting a motor vehicle 12 which has a unit body construction body construction, including a frame comprising a sub-floor 14 and rocker panel 15 welded on their upper side to the main vehicle body and terminating in a downwardly directed relatively flat pinch weld section 16 (FIGS. 1 and 3).

The illustrated apparatus 10 includes a frame press 18 comprising a bed 19 having a pair of elongated structural members 19*a* interconnected by transverse structural members 19*b*. The bed 19 is supported at opposed ends in a known manner by extensible supports, each in this instance comprising a pivot frame 20 pivotably mounted at its upper end to brackets 21 depending from the underside of the bed 19 with the lower end of the pivot frame having ground wheels 22. For vertically raising and lowering the frame press bed 19 with respect to ground level, a pneumatic cylinder 24 is supported at its lower end on a plate 25 pivotally mounted on the pivot frame 20 and has an appropriate piston rod coupled to the underside of the bed 19. Actuation of the air cylinder 24 will extend the piston rod thereof causing the pivot frame 20 to be pivoted toward an upright position, thereby elevating the bed 19. As is known in the art, the rollers 22 permit the frame press to be manually moved into position for use, either before or after a vehicle 12 is driven onto the ramps 11.

In accordance with the invention, a clamping arrangement is provided for reliably engaging the underside frame of a unit body constructed vehicle for retaining the vehicle in position on the frame press during a straightening operation and for facilitating elevation of the vehicle relative to the runways upon which the vehicle is initially positioned. In the illustrated embodiment, a four-point clamping and support arrangement is provided which includes four clamping heads 30, two of which are mounted on each side of the frame press 18 for engaging a respective side of the vehicle frame. The pairs of forward and rearward clamping heads 30 in this case are mounted on respective cross beams 31. To facilitate such mounting, each clamping head 30 has a channel section 32 on an underside thereof which defines a rectangular opening for positioning onto the similarly shaped transversely disposed cross beam 31. The illustrated clamping heads 30 also have a second lowermost channel section 34 which defines a longitudinally directed opening for receiving and supporting an appropriate longitudinal support beam if desired.

The cross beams 31 in this instance are mounted upon selectively adjustable vertical support columns 35. For this purpose, the vertical support columns 35 carry a pair of perpendicularly oriented beam receiving channels 38, 39 at the top thereof. The uppermost channel 38 defines a transversely oriented, rectangular opening shaped for receiving the cross beam 31, and the channel 39 immediately therebelow has a generally square shaped opening for receiving a similarly sized longitudinal support beam 40. The clamping head channels 32, 34 and the vertical column channels 38, 39 each have a bolt 44 threadedly carried in a side thereof, which may be tightened to secure the mounting between the beam and channel.

Figure 2:
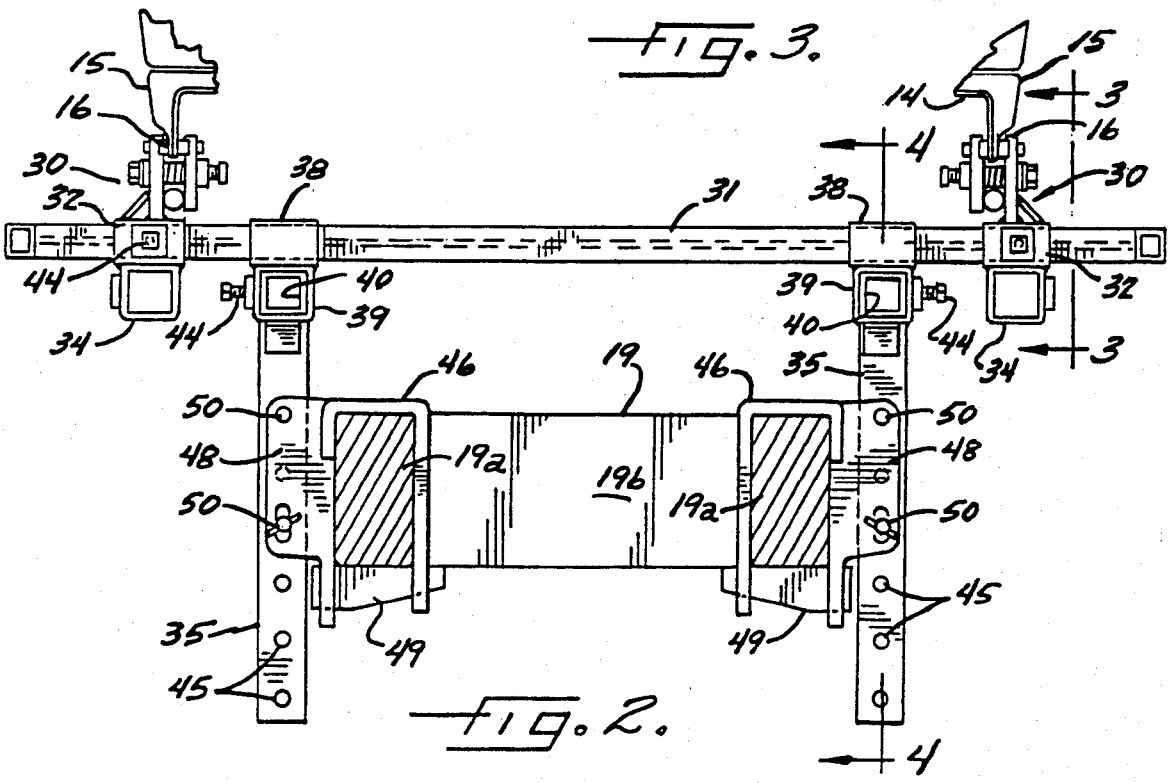
FIG. 2 is an enlarged vertical section taken in the plane of line 2—2 in FIG. 1.
Figure 4:
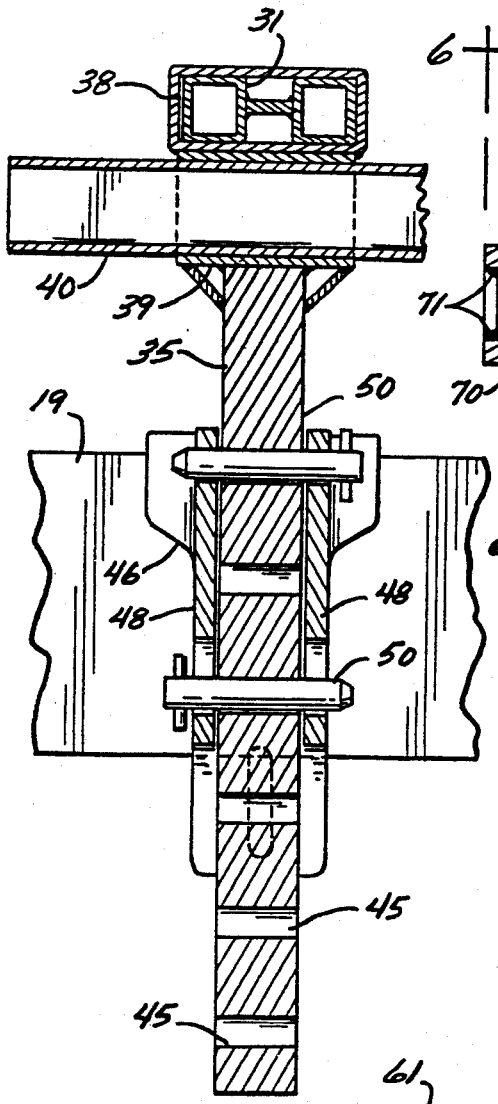
FIG. 4 is an enlargement vertical section taken in the plane of line 4—4 in FIG. 2.

For permitting selective vertical adjustment of the vertical columns 35, and thus the vertical position of the longitudinal beams 40, cross beams 31, and clamping heads 30, the vertical columns 35 each are mounted on a respective yoke 46 carried by the frame press bed 19 and are formed with a plurality of vertically spaced apertures 45 (FIG. 2). The yokes 46 are positioned over and straddle a respective longitudinal support 19*a* of the frame press bed 19 and have a pair of vertical, support-receiving flanges 48 extending outwardly therefrom. The lowermost ends of each yoke 46 extend below the frame press bed 19 and are slotted for receiving a locking wedge 49. The vertical columns 35 may be selectively positioned in the yoke flanges 49 and secured in place by pins 50 extending through the flanges 48 and the desired column apertures 45 for proper positioning of the clamping heads 30 with respect to the frame of a vehicle 12 positioned on the ramps 11.

Figure 5:
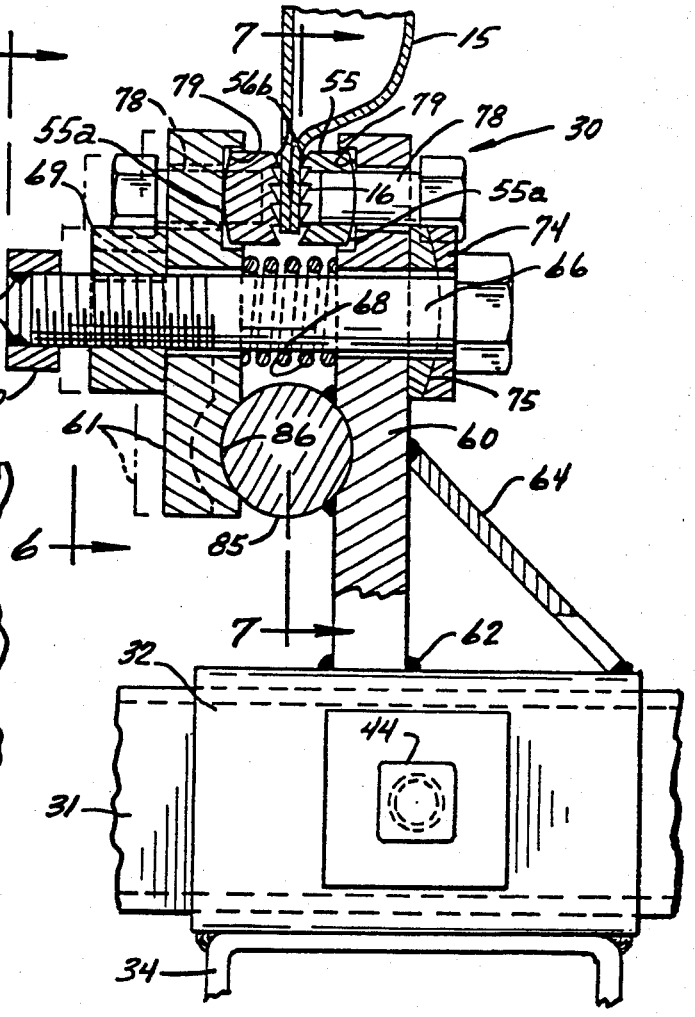
FIG. 5 is an enlarged vertical section taken in the plane of line 5—5 in FIG. 3.
Figure 6:
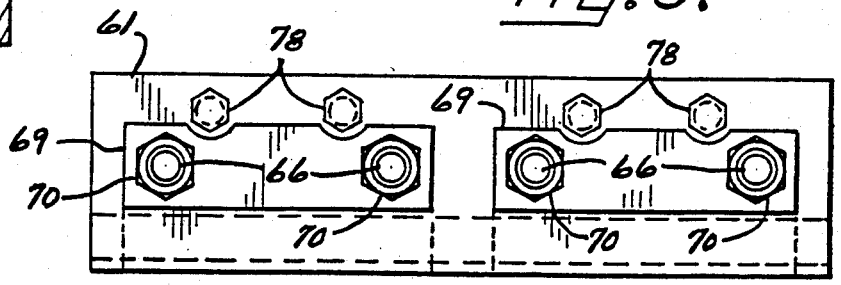
FIG. 6 is an end view taken in the plane of line 6—6 in FIG. 5.
Figure 7:
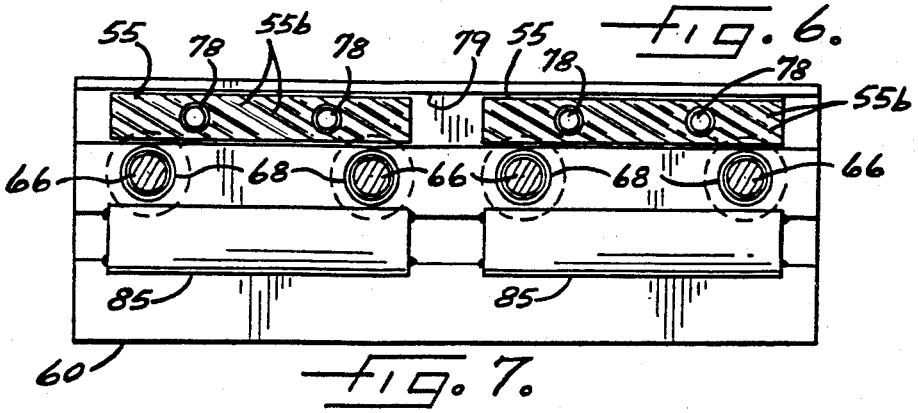
FIG. 7 is a vertical section taken in the plane of line 7—7 in FIG. 5.

In keeping with the invention, the clamping heads each have outwardly biased floating clamping-jaws 55 that are adapted for easy and secure engagement with the frame of a unit body constructed motor vehicle. The clamping heads 30 in this case each include a fixed clamping jaw support 60 mounted in upstanding relation on top of the channel 32 and a relatively movable clamping jaw support 61 (FIG. 5). The fixed support 60 is secured to the channel 32 by weldments 62, and a diagonal flange plate 64 is welded between the side of the upstanding support 60 and the channel 32 for added rigidity.

For mounting the movable jaw support 61 for transverse movement relative to the fixed support 60, a pair of mounting bolts 66 extend through oversized appetures in both the fixed and movable jaw supports 60, 61 so as to permit limited relative movement therebetween. A spring 68 is carried by each mounting bolt 66 in interposed relation between the supports 60, 61 for biasing the movable support 61 in an outward direction with respect to the fixed support 60. To permit selected clamping movement of the movable support with respect to the fixed support, a nut plate 69 is fixed to the outside of the movable support 61 and is formed with threaded apertures which receive respective threaded ends of the mounting bolts 66. Appropriate rotation of the mounting bolts 66 will thereby permit advancement or retraction of movable jaw support 61 relative to the mounting bolts 66 and the fixed support 60. To prevent accidental removal of the mounting bolts 66 from the nut plate 69, nuts 70 are captively secured to the ends of the mounting bolts 69, such as by weldments 71. A pair of concave, convex washers 74, 75, respectively, are interposed between the heads of the bolts 66 and the fixed support 60 for permitting secure tightening of the bolts notwithstanding their slightly tilted position relative to the supports 60, 61.

In carrying out the invention, the jaws 55 are mounted for floating movement relative to the respective support 60, 61 by being disposed on the ends of bolts 78 that are loosely carried in respective apertures of the supports 60, 61 for limited relative movement. To facilitate a self-aligning action of the floating jaws upon their engagement with a section of a vehicle frame, each jaw 55 has a rear face 55*a* formed with a concave shape and received in a flat bottom channel 79 in the respective jaw support. It will be seem that the combination of such concave rear jaw face 55*a* and the relatively loose fit between the jaw mounting bolts 78 and the supports 60, 61 permits limited rocking movement of the jaws 55 as they are brought into engagement with a frame section to be clamped. For enhancing secure engagement of a vehicle frame upon movement of the jaw supports 60, 61 and clamping jaws 55 into clamping position, the jaws 55 preferably are formed with a serrated gripping surface 55*b* which defines teeth adapted to resist forces exerted on the vehicle during straightening.

To further facilitate proper positioning of the jaws 55 into clamping engagement, a spacing rod 85 is interposed between a lower end of the movable jaw support 61 and the fixed jaw support 60. The spacing rod 85 is welded to the fixed support 60 such that upon transverse movement of the movable support 61 into clamping position, the rod 85 maintains the movable support 61 in substantially parallel relation to the fixed support 60. For guiding movement of the movable support 61 into engagement with the spacing rod 85, the spacing rod 85 has a cylindrical shape and the movable support 61 is formed with a slight cylindrical recess 86 for receiving the rod. It will be understood that the spacing rod 85 could alternatively be fixed to the movable support 61.

In use of the apparatus 10, it will be seen that with the frame press bed 19 in a lowered position, an automobile 12 may be driven onto the ramps 11 and the clamping heads 30 appropriately mounted on the frame press bed 19 in position for engaging determined sections of the rocker panel pinch weld section 16 of the vehicle frame for providing a desired four point support. The biasing springs 68 maintain the clamping jaws 55 in their opened condition so as to permit easy positioning of the clamping heads about the pinch weld section 16. By rotating the mounting bolts 66, such as by wrench, the bolts 66 can be threadably advanced through the nut plate 69, drawing the movable jaw support 61 toward the fixed jaw support 60 and drawing the jaws 55 into engagement with the pinch weld section 16. During such tightening action, the spacing rod 85 maintains the jaw supports 60, 61 in substantially parallel relation and the concave rear faces 55*a* of the jaws 55 allow the jaws to float into proper engagement with the pinch weld 16 notwithstanding slight irregularities or uneveness in the surface.

With the vehicle frame securely engaged by the clamping heads 30, the frame press bed 19 may be elevated to reduce the tension on the vehicle suspension system or completely raise the vehicle 12 from the ramps 11. With the vehicle secured in such manner, pull rams or other suitable force exerting means also may be appropriately secured to the vehicle for exerting the necessary forces to the frame and body to affect the desired reshaping. The clamping heads 30 provide reliable and safe engagement and support for the vehicle, both during elevation and during the straightening operation. Through utilization of a plurality of elongated jaws in each clamping head, it will be appreciated that forces are distributed over a sufficient area of the vehicle frame so as not to deform or otherwise damage the frame at the points of attachment.

Figure 8:
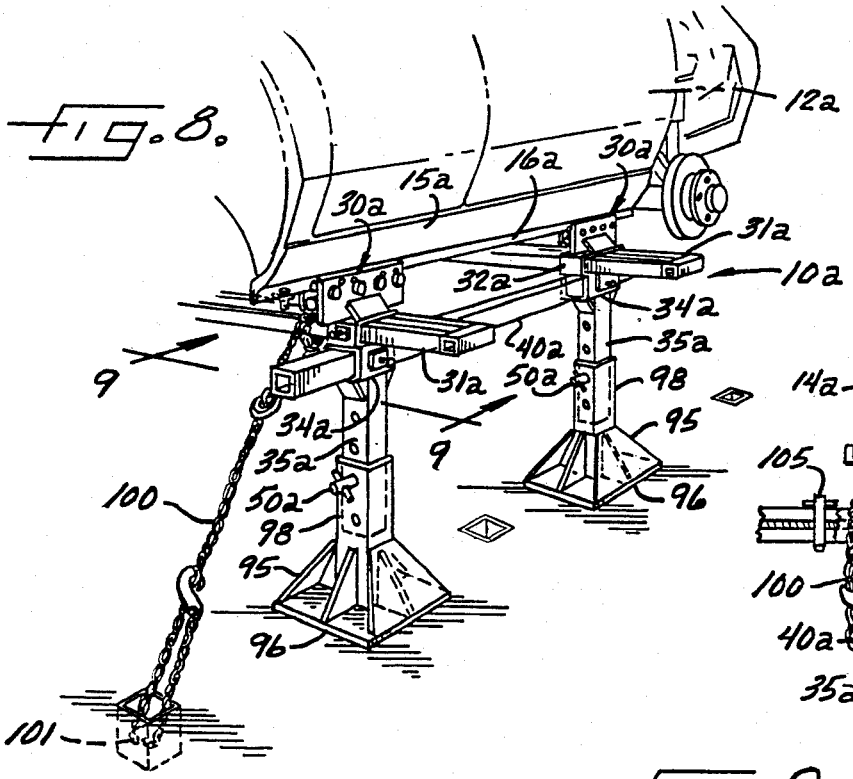
FIG. 8 is an alternative embodiment of vehicle engagement and support apparatus embodying the present invention.
Figure 9:
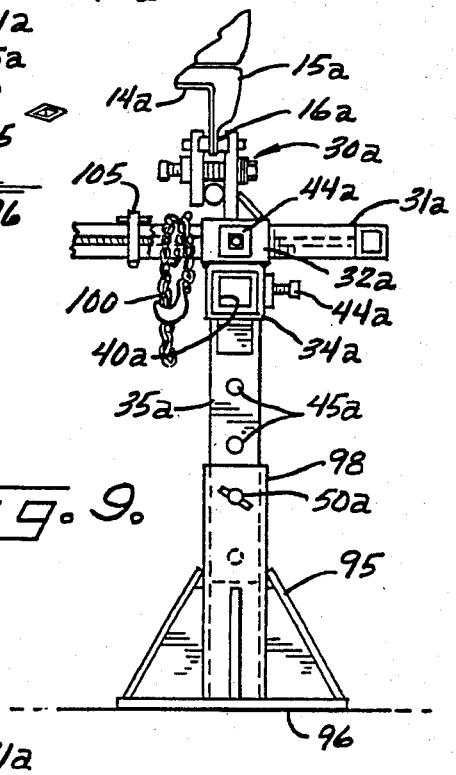
FIG. 9 is an enlarged end view taken in the plane of line 9—9 in FIG. 8.
Figure 10:
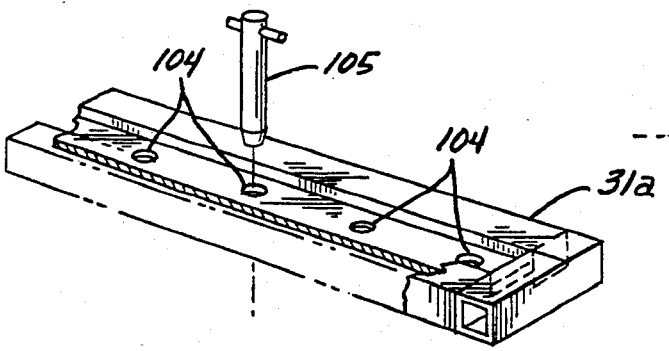
FIG. 10 is a perspective of one of the cross members shown in the apparatus of FIG. 8 with a chain attaching pin removed.

Referring now to FIGS. 8–10, there is shown an alternative ground supported vehicle engaging and support apparatus 10*a* for use in vehicle frame and body straightening, wherein items similar to those discussed above have been given similar reference numerals with the distinguished suffix "a" added. The apparatus 10*a* similarly includes a four point support arrangement comprising two clamping heads 30*a* on each side of a vehicle 12*a*, each being supported by appropriate vertical support columns 35*a*. The clamping heads 30*a* in this case are mounted directly on the top of the verticle columns 35*a* through a first transversely oriented channel 32*a* and a second longitudinally oriented channel 34*a* immediately therebelow. For tying the individual clamping heads 30*a* into a unitized support structure, cross beams 31*a* extend through the transversely oriented channels 32*a* for interconnecting the respective forward and rear pairs of clamping heads 30*a*, and longitudinal support beams 40*a* extend through the longitudinally oriented channels 34*a* for coupling clamping heads 30*a* together on each side of the vehicle. Locking bolts 44*a* again permit securement of the respective cross beams 31*a* and longitudinal beams 40*a* in their desired mounted positions. For supporting the columns 35*a* in selected vertical position, ground stands 95 are provided which each have a base 96 and an upstanding substantially square shaped channel section 98 for receiving a respective column 35*a*. A locking pin 50*a* is carried in the side of each channel section 98 for securing the column 35*a* at the desired height.

It will be appreciated that a vehicle 12*a* whose frame is to be straightening typically would be raised and held in elevated position by jacks or the like while the frame engaging apparatus 10*a* is positioned under the vehicle and the clamping heads 30*a* are appropriately engaged at desired locations to the vehicle rocker panel pinch weld section 16*a*. With the vehicle so positioned, ropes or chains 100 also may be secured between the cross members 31*a* and suitable floor anchors 101 or the like for added support. With the vehicle properly supported by the clamping heads 30*a*, the jacks may then be removed for use elsewhere in the shop or to permit better working access to the underside of the vehicle. Again, suitable pull rams may be utilized in a known matter to effect the desired reshaping of the vehicle frame and body. To facilitate connection of chains, ropes and pull rams to the cross beams 31*a*, the cross beams 31*a* preferably are formed with apertures 104 for receiving attachment pins 105, as shown in FIG. 10. While the clamping heads 30*a* are shown in FIGS. 8 and 9 as being fixed to the upper end of the support column 35*a*, it will be understood that the clamping heads alternatively could be separately mounted on the cross members 31*a* as previously described.

From the foregoing, it can be seen that the apparatus of the present invention is particularly adapted for efficient and reliable use in straightening of frames of unit body constructed motor vehicles. The apparatus can be employed to reliably clamp and secure the vehicle body in place during the straightening operation, as well as for enabling the vehicle to be elevated and supported at such points of frame engagement. It will be understood that while the invention has been shown for use with a unit body constructed vehicle, it could also be used with vehicles having other frame constructions. Moreover, it will be appreciated that the clamping heads of the present invention may be used with a four point support arrangement as illustrated, or with individual ground support columns, or simply as a general purpose clamp for securing the vehicle frame during the straightening process. In each instance, the apparatus can be easily applied to and removed from the vehicle and is adapted for secure engagement with the vehicle frame.

What is claimed is:

1. A motor vehicle frame support apparatus for use in straightening of vehicle bodies and frames comprising base means, a plurality of frame engaging clamping heads, means for selectively mounting said clamping heads on said base means in determined location with respect to a vehicle frame to be straightened, said clamping heads each including a pair of relatively movable jaw supports each carrying a clamping jaw, means biasing said jaw supports in an outwardly open position for receiving a respective section of said vehicle frame between said clamping jaws, means associated with each clamping head for selectively causing relative transverse movement of the jaw supports against the force of said biasing means for engaging said vehicle frame between the jaws, said jaw supports of each clamping head having opposed faces and means interposed between said faces for maintaining a spacial separation between said jaw supports during clamping, said jaw support separation means comprising a cylindrical rod fixed to the face of one of the jaw supports of each clamping head and the face of the other of said jaw support being recessed to receive said rod during clamping, and floating mounting means for supporting said jaws on said supports for limited pivotal movement relative to said supports during clamping for enhancing reliable engagement of the jaws with the vehicle frame.

2. The apparatus of claim 1 in which one jaw support of each clamping head is fixed to said clamping head mounting means, and means for carrying the other jaw support of each clamping head for limited transverse movement with respect to the fixed jaw support.

3. The apparatus of claim 2 including mounting bolts extending through said fixed and movable jaw supports and loosely carrying said movable jaw support for relative movement, and said movable jaw support having means in threaded engagement with said bolts such that upon rotation of said bolts said movable jaw support is moved relative to said bolts and said fixed jaw support.

4. The apparatus of claim 3 in which a plurality of mounting bolts extend through said movable jaw support, and said movable jaw support threaded engagement means includes a single nut plate in threaded engagement with each of said plurality of mounting bolts.

5. The apparatus of claim 3 including floating mounting means for supporting the jaws thereof for limited relative pivotal movement during said relative transverse clamping movement for enhancing reliable engagement of the jaws with said vehicle frame, said floating jaw mounting means comprising mounting bolts loosely carried in the respective jaw support and supporting said jaws at outwardly extending ends thereof.

6. The apparatus of claim 5 in which said jaws each have a frame engaging surface and a rear concave shaped surface for facilitating limited pivotal movement of the jaw relative to the respective jaw support during jaw clamping movement.

7. The apparatus of claim 6 in which said frame engaging jaw surface is formed with gripping teeth.

8. The apparatus of claim 5 including a pair of concave and convex cooperating washers interposed between the end of each of said bolts and said fixed jaw support for permitting slight tilting movement of said bolts relative to said fixed support during clamping jaw movement.

9. The apparatus of claim 1 in which said base means is a frame press having a bed upon which said clamping heads are mounted, and means for selectively elevating and lowering said bed and the clamping heads mounted thereon.

10. The apparatus of claim 9 including clamping head mounting means for selectively mounting said clamping heads in determined transverse, longitudinal and vertical relation to said frame press bed.

11. The apparatus of claim 10 in which said clamping head mounting means includes a plurality of cross beams transversely disposed relative to said bed and a plurality of longitudinal supports longitudinal disposed relative to said bed, means for supporting said clamping heads on said cross beams and longitudinal supports at selected longitudinal and transverse positions, and means for selectively raising and lowering said frame press bed, cross beams, longitudinal supports, and clamping heads mounted thereon.

12. The apparatus of claim 11 in which said clamping head mounting means includes the first channel means for receiving one of said cross beams and second channel means for receiving one of said longitudinal supports.

13. The apparatus of claim 12 in which said first and second channel means are mounted in vertically stacked relation below said clamping jaws.

14. The apparatus of claim 1 in which said base means includes a plurality of ground stands, and said clamping head mounting means for each clamping head includes a column adapted for selected vertical mounting in said ground stand.

15. A clamping device for use with motor vehicle frame straightening apparatus comprising a pair of transversely spaced jaw supports mounted for relative transverse movement and each carrying a clamping jaw, means biasing said supports in an outward jaw opening position for receiving a section of a vehicle frame between said jaws, means for selectively causing relative transverse movement of said supports and the jaws carried thereon against the force of said biasing means for engaging said vehicle frame section between said jaws, and floating mounting means for mounting said jaws on said supports for limited pivotal movement relative to said supports during transverse clamping movement of said supports and jaws for enhancing reliable engagement of the jaws with said vehicle frame section, said floating jaw mounting means comprising mounting bolts loosely carried in the respective jaw support and supporting said jaws at outwardly extending ends thereof.

16. The apparatus of claim 15 including means fixedly carrying one of said jaw supports in upstanding fashion, and means for carrying the other jaw support for limited transverse movement with respect to the fixed jaw support.

17. The apparatus of claim 16 in which said fixed jaw support carrying means includes a first channel mounted below said jaw supports and defining a support beam receiving opening of predetermined orientation.

18. The apparatus of claim 17 including second channel means mounted below said first channel means for defining a support beam receiving opening oriented perpendicularly to the opening of said first channel means.

19. The apparatus of claim 16 including adjustable mounting bolts extending through said fixed and movable jaw supports and loosely carrying said movable jaw support for relative movement, and said movable jaw support having means in threaded engagement with said adjustable mounting bolts such that upon rotation of said adjustable mounting bolts said movable jaw support is moved relative to said adjustable mounting bolts and said fixed jaw support.

20. The apparatus of claim 19 in which a plurality of adjustable mounting bolts extend through said movable jaw support, and said movable jaw support threaded engagement means includes a single nut plate in threaded engagement with each of said plurality of mounting bolts.

21. The apparatus of claim 15 in which said jaws each have a frame engaging surface formed with gripping teeth and a rear concave shaped surface for facilitating limited pivotal movement of the jaw relative to the respective jaw support during jaw clamping movement.

22. The apparatus of claim 15 in which said jaws are carried at one end of said jaw supports, and means are interposed between the opposite ends of said jaw supports for maintaining a spacial separation between said jaw supports during clamping.

23. The apparatus of claim 22 in which said jaw support separating means is a cylindrical rod fixed to one of said jaw supports and the other of said jaw supports is recessed to receive said rod during clamping, and including a pair of concave and convex cooperating washers interposed between the end of each of said adjustable mounting bolts and said fixed jaw support for permitting slight tilting movement of said adjustable mounting bolts relative to said fixed support during clamping jaw movement.

* * * * *